US009683452B2

(12) United States Patent
Luneau et al.

(10) Patent No.: US 9,683,452 B2
(45) Date of Patent: Jun. 20, 2017

(54) LABYRINTH SEAL FOR GAS TURBINE ENGINE TURBINE

(71) Applicant: SNECMA, Paris (FR)

(72) Inventors: Florent Pierre Antoine Luneau, Alfortville (FR); Alain Dominique Gendraud, Vernou la Celle sur Seine (FR); Patrick Joseph Marie Girard, Saint Fargeau Ponthierry (FR); Sebastien Jean Laurent Prestel, Coubert (FR)

(73) Assignee: SNECMA, Paris (FR)

( * ) Notice: Subject to any disclaimer, the term of this patent is extended or adjusted under 35 U.S.C. 154(b) by 665 days.

(21) Appl. No.: 14/134,405

(22) Filed: Dec. 19, 2013

(65) Prior Publication Data

US 2014/0105732 A1 Apr. 17, 2014

Related U.S. Application Data

(63) Continuation-in-part of application No. PCT/FR2012/051492, filed on Jun. 28, 2012.

(30) Foreign Application Priority Data

Jun. 30, 2011 (FR) ..... 11 55909

(51) Int. Cl.
*F01D 11/12* (2006.01)
*F01D 11/00* (2006.01)

(52) U.S. Cl.
CPC ..... *F01D 11/122* (2013.01); *F01D 11/001* (2013.01); *F05D 2250/283* (2013.01)

(58) Field of Classification Search
CPC ..... F01D 11/122; F01D 11/011
See application file for complete search history.

(56) References Cited

U.S. PATENT DOCUMENTS 3,339,933 A 9/1967 Foster
4,169,020 A * 9/1979 Stalker ..... F01D 5/20 205/110

(Continued)

FOREIGN PATENT DOCUMENTS

EP 1 264 964 A1 12/2002
EP 1 291 494 A1 3/2003

(Continued)

OTHER PUBLICATIONS

International Search Report issued Aug. 29, 2012 in PCT/FR2012/051492 filed Jun. 28, 2012.

*Primary Examiner* — Woody Lee, Jr.
(74) *Attorney, Agent, or Firm* — Oblon, McClelland, Maier & Neustadt, L.L.P.

(57) ABSTRACT

A turbine for a gas turbine engine comprising at least one turbine stator and one turbine rotor, said turbine stator comprising at least one inner annular platform, said inner platform comprising a radial wall delimiting at least one cavity between the turbine stator and the turbine rotor, wherein the turbine rotor comprises at least one elongate element positioned substantially axially and defining a sealing baffle in said cavity, and in that the turbine stator comprises at least one element made of abradable material designed to engage with said elongate element of the turbine rotor so as to form a labyrinth seal.

12 Claims, 6 Drawing Sheets

(56) References Cited

U.S. PATENT DOCUMENTS

| | | | | |
|---|---|---|---|---|
| 6,152,690 | A * | 11/2000 | Tomita | F01D 11/001 415/173.7 |
| 9,145,788 | B2 * | 9/2015 | Adaickalasamy | F01D 11/122 |
| 2002/0187046 | A1 | 12/2002 | Beutin et al. | |
| 2004/0222595 | A1 * | 11/2004 | Gueldry | F01D 11/001 277/410 |
| 2008/0056895 | A1 | 3/2008 | Senoo | |
| 2009/0014964 | A1 * | 1/2009 | Pu | F01D 11/001 277/414 |
| 2009/0067997 | A1 * | 3/2009 | Wu | F01D 11/001 415/173.7 |
| 2009/0238683 | A1 * | 9/2009 | Alvanos | F01D 11/001 415/173.7 |
| 2010/0254806 | A1 * | 10/2010 | Deodhar | F01D 11/001 415/173.7 |
| 2013/0108450 | A1 * | 5/2013 | Ingram | F01D 5/143 416/223 A |

FOREIGN PATENT DOCUMENTS

| | | | |
|---|---|---|---|
| EP | 1 967 700 | A2 | 9/2008 |
| EP | 2 105 581 | A2 | 3/2009 |
| EP | 2 206 887 | A2 | 7/2010 |
| EP | 2 239 422 | A2 | 10/2010 |

* cited by examiner

LABYRINTH SEAL FOR GAS TURBINE ENGINE TURBINE

BACKGROUND OF THE INVENTION

Field of the Invention

The present invention relates to the field of gas turbine engines, such as a jet engine or a turboprop engine for an airplane, and more specifically to a sealing device for a turbine of such an engine.

Description of the Related Art

A twin-body engine having a front fan, for example, comprises, from upstream to downstream, a fan, a low-pressure compressor, a high-pressure compressor, a combustor, a high-pressure turbine and a low-pressure turbine.

By convention, in the present application, the terms "upstream" and "downstream" are defined with respect to the direction of the flow of air in the jet engine. Similarly, by convention in the present application, the terms "interior" and "exterior", "inferior" and "posterior", and "inner" and "outer" are defined radially with respect to the axis of the engine. Thus, a cylinder which extends along the axis of the engine comprises an interior face, oriented toward the axis of the engine, and an exterior surface, oriented away from the interior surface of the cylinder.

A turbine of a gas turbine engine comprises several stages, each having a bladed rotor and a stator. Each rotor comprises a disk which bears, at its outer periphery, substantially radial blades, with the disks of the various wheels being connected coaxially to one another and to the drive shaft of the rotor of the turbine by appropriate means. Every stator comprises an inner annular platform and an outer annular platform, between which extend substantially radial vanes. The outer platform of the stator comprises means for latching and fastening onto an outer casing of the turbine.

The inner platform comprises a wall extending in the radial direction and an annular annulus connected to the wall. The wall and the annular annulus thus delimit an upstream cavity and a downstream cavity between the turbine stator and the turbine rotor. The annulus, the radial wall and the inner platform of the stator are generally formed of sectors, each having a single casting.

In use, the stator vanes are exposed to the hot gases flowing in the turbine duct. The temperature of the gases in the duct is relatively high, typically of the order of 900 degrees Celsius, whereas the temperature in the region between the inner platform of the stator and the rotor is lower, for example approximately 700 degrees Celsius.

In order to consolidate this temperature difference, a known turbine rotor comprises an upstream spur and a downstream spur, each defining a sealing baffle in, respectively, the upstream cavity and the downstream cavity delimited by the wall and the annular annulus so as to form a seal of the baffle effect type. The use of such spurs does not, however, make it possible to achieve sufficient fluidtightness given that the flow of gas can still pass through the sealing baffles formed upstream and downstream between the stator and the rotor. In particular, air recirculation vortices or eddies form and enter the cavities.

Moreover, a known annular annulus for a stator of a turbomachine further comprises, radially on its outer portion, one or more annular elements made of abradable material, designed to engage with outer annular lamellar elements, known as lips, of an element of the rotor, arranged radially so as to form a labyrinth seal. Such a seal makes it possible to direct the flow of air passing axially through the annular space located between the inner periphery of the stator and the rotor of the turbine. Thus, when the turbine rotor is in rotation, the lips of the labyrinth seal are driven in rotation while maintaining as little clearance as possible with respect to the abradable elements which remain stationary.

However, positioning the abradable elements in this way at the outer portion of the annular annulus, in a manner which extends the wall, means that their thermal inertia is considerable. This, in combination with the lower temperature to which they are exposed, acts counter to the thermal expansion of the stator vanes which are then subjected to substantial mechanical stresses. This can result in cracks appearing in these vanes, the life of which is shortened considerably.

BRIEF SUMMARY OF THE INVENTION

In order to eliminate these drawbacks, at least in part, the invention relates to a turbine for a gas turbine engine comprising at least one turbine stator and one turbine rotor, said turbine stator comprising at least one annular platform, such as an inner platform, said platform comprising a radial wall delimiting at least one cavity between the turbine stator and the turbine rotor, the turbine being characterized in that the turbine rotor comprises at least one elongate element positioned substantially axially and defining a sealing baffle in said cavity, and in that the turbine stator or an element carried by said turbine stator comprises at least one element made of abradable material designed to engage with said elongate element of the turbine rotor so as to form a labyrinth seal.

The platform may be an inner platform or an outer platform.

The platform preferably comprises a radial wall delimiting an upstream cavity and a downstream cavity between the turbine stator and the turbine rotor, the turbine rotor comprising an upstream spur and a downstream spur positioned substantially axially and each defining a sealing baffle in its said respective cavity, the turbine stator comprising at least one element made of abradable material designed to engage with at least one spur of the turbine rotor so as to form a labyrinth seal.

A labyrinth seal is thus created in the cavity, as close as possible to the duct of the flow of air through the stator vanes. This seal provides better fluidtightness and thus has a direct effect on the life of the surrounding parts.

The element made of abradable material is preferably designed to engage with at least one downstream spur of the turbine rotor so as to form a labyrinth seal. The seal can thus be formed in the event that the static assembly formed by the stators, or locally by one or more stators, moves back with respect to the moving assembly formed by the turbine rotor, which is often the case.

The plane defined by the surface at which the spur contacts the element made of abradable material is preferably substantially perpendicular to the axis of the turbine rotor. This makes it possible to produce an axial seal designed to be located as close as possible to the duct of the flow of air (as opposed to the radial seals of existing solutions).

Advantageously, the element made of abradable material is mounted on the radial wall of the turbine stator. This avoids the need to add additional elements such as a support. The thickness of the abradable element is then adapted such that it skims the spur of the rotor.

According to one feature of the invention, the element made of abradable material is mounted on the radial wall by brazing.

According to another feature of the invention, the turbine stator further comprises support means (such as a ring) mounted on the radial wall and arranged so as to support the element made of abradable material. This makes it possible to position the abradable element whatever its thickness such that it skims the spur of the rotor.

According to one aspect of the invention, the spur comprises at least one opening arranged so as to vent an overpressure of air from the corresponding cavity.

According to another feature of the invention, the spur of the rotor for a turbine comprises a plurality of elements arranged one after the other, each of the elements being designed to engage with the element made of abradable material. This makes it possible to better use, manage and optimize the abradable part and thus to avoid the spur jamming in said abradable part.

Each of the elements preferably further comprises an opening for venting the overpressure of air from the corresponding cavity.

The invention also relates to a turbine stator for a turbine as defined hereinabove, said turbine stator comprising at least one element made of abradable material which is designed to engage with at least one spur of a turbine rotor of said turbine so as to form a labyrinth seal.

The invention also relates to a turbine rotor for a turbine as defined hereinabove, in which at least one spur is designed to engage with an element made of abradable material of a turbine stator of a labyrinth seal.

The stiffness of the end of the spur has preferably been increased by heat treatment or by adding a hardening deposit. Such a strengthening measure strengthens, in particular, the tip of the spur and improves the abrasion of the abradable element by the spur.

The invention also relates to a method for strengthening a spur for a rotor of a turbine as defined hereinabove, said spur being positioned substantially radially with respect to the axis of rotation of the rotor of the turbine, the method being noteworthy in that it comprises a step of hardening the spur by heat treatment or by a hardening deposit. Such a strengthening measure makes the spur more solid and improves the quality of the abrasion of the abradable element by the spur.

BRIEF DESCRIPTION OF THE SEVERAL VIEWS OF THE DRAWINGS

Other features and advantages of the invention will appear in the following description, with reference to the appended figures which are given as purely non-limiting examples (wherein identical references are given to similar objects) and in which.

DETAILED DESCRIPTION OF THE INVENTION

The present invention is described with reference to a turbine of an aircraft turbomachine, but applies to any type of turbine of a gas engine which functions in a similar manner.

Figure 1:
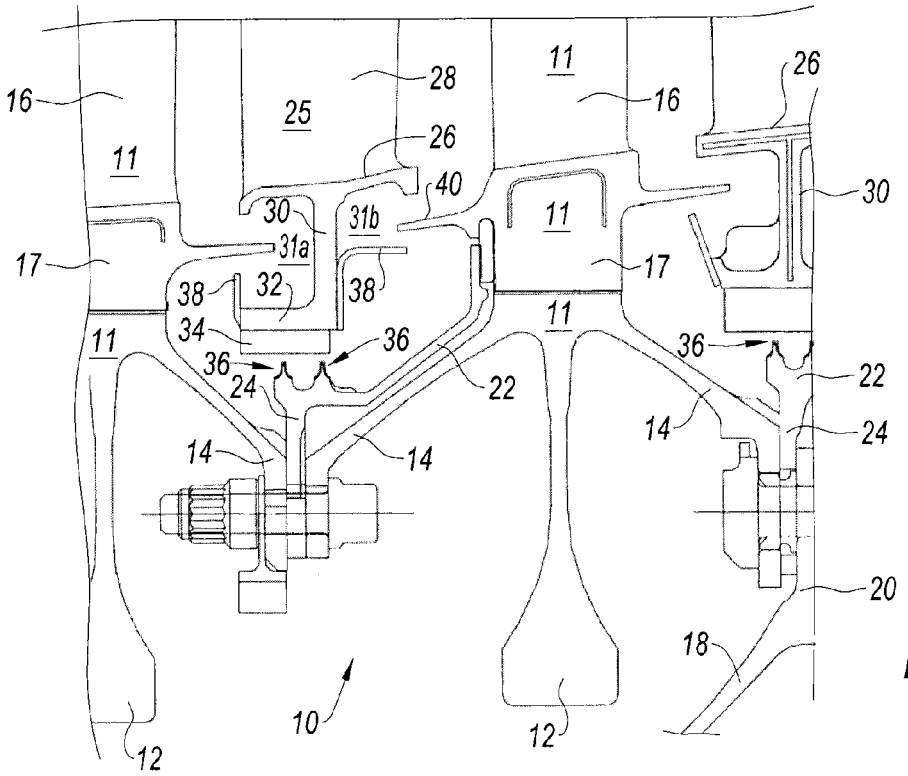
FIG. 1 is a view in axial section of a first rotor according to the prior art.

Reference is first made to FIG. 1, which is a schematic half-view in section of a low-pressure turbine 10 of a gas turbine engine, through a plane passing through the axis of rotation 13 of the rotor 11 of the turbine 10. The rotor 11 of the turbine 10 comprises disks 12 assembled coaxially with each other by annular attachment flanges 14 and bearing annular rows of moving blades 16 which are mounted, for example by means of dovetail-shaped or similarly shaped blade roots at their radially inner ends, on the outer periphery of the disks 12. The rotor 11 is connected to a turbine shaft via the intermediary of a drive taper 18 attached by means of an annular attachment flange 20 between the annular attachment flanges 14 of the disks 12. Annular retaining flanges 22 for the axial retention of the moving blades 16 on the disks 12 are moreover mounted between the disks 12 and each comprise a radial wall 24 which is gripped axially between the annular attachment flanges 14 of two adjacent disks 12. Stators 25 are present between the rows of moving blades 16 and each comprise two annular platforms, respectively an inner platform 26 and an outer platform (not shown), which are connected to each other by an annular row of stationary vanes 28. The outer platforms of the stators 25 are latched, by appropriate means, onto a casing of the low-pressure turbine 10. The inner platforms 26 of the stators 25 each comprise a radial wall 30 which extends radially inward from an inner surface of the platform 26 and which is connected at the inner periphery thereof to a cylindrical annulus 32 for supporting annular elements 34 made of abradable material. The regions defined between the inner wall 26, the radial wall 30 and the annular annulus 32 thus form two cavities 31*a* and 31*b*.

These abradable elements 34 are arranged radially outside and facing outer annular lips 36 borne by the retaining flanges 22. The lips 36 are designed to engage with the abradable elements 34 so as to form labyrinth seals whose sealing plane is parallel to the axis of rotation 13 of the turbine rotor 11, thus restricting any axial movement of air through these seals.

The cylindrical annulus 32 comprises, upstream and downstream, annular rims 38 which extend substantially axially on the opposite side from the radial wall 30 of the inner platform 26 of the stator 25. Substantially cylindrical upstream and downstream spurs 40 are formed so as to project axially from the roots 17 of the moving blades 16, extending into the cavities 31*a* and 31*b*, and thus engaging by means of the baffle effect with these annular rims 38 and with the upstream and downstream edges of the inner platforms 26 so as to limit any recirculation (vortices) of hot gases from the duct of the turbine 10 radially inward at the labyrinth seals. The annulus 32 and the radial wall 30 of each stator 25 can be formed from a single casting with the inner platform 26 of this stator 25.

As described hereinabove, one drawback of the rotor 11 according to the prior art, described in FIG. 1, relates to the passage of a flow of hot air between the upstream and downstream spurs 40 and the radial wall 30 of the stator 25, even when the ends of the downstream spur 40 and of the annular rim 38 partially overlap.

Therefore, in order to solve this problem, a labyrinth seal is produced at at least one of the spurs, upstream or downstream, or at both spurs, upstream and downstream, located on either side of a same radial wall 30 of the stator.

FIGS. 2 to 6 describe five embodiments of the invention in which an element 44 made of abradable material is mounted on the radial wall 30 of the stator or on support means 46 mounted on the radial wall 30 of the stator 25 and in which one of the spurs 40 is replaced by a spur 42 designed to act as a lip in order to form a labyrinth seal whose sealing plane is perpendicular to the axis of rotation 13 of the turbine rotor 11, thus limiting the flow of hot air as close as possible to the duct of the flow of air flowing through the blades 16 of the rotor 11 and the vanes 28 of the stators 25.

Unlike a lip which has not been hardened or stiffened, a spur 42 of this type remains substantially rigid.

The end of such a spur 42 can be hardened or strengthened such that it skims the element made of abradable material while avoiding the spur 42 becoming jammed in the abradable material 44.

In operation, the spur 42 thus tends to enter the abradable material and provides tailor-made sealing for each cavity.

The abradable material 44 may have various cross sections and skims the spur with which it forms the seal.

Figure 2:
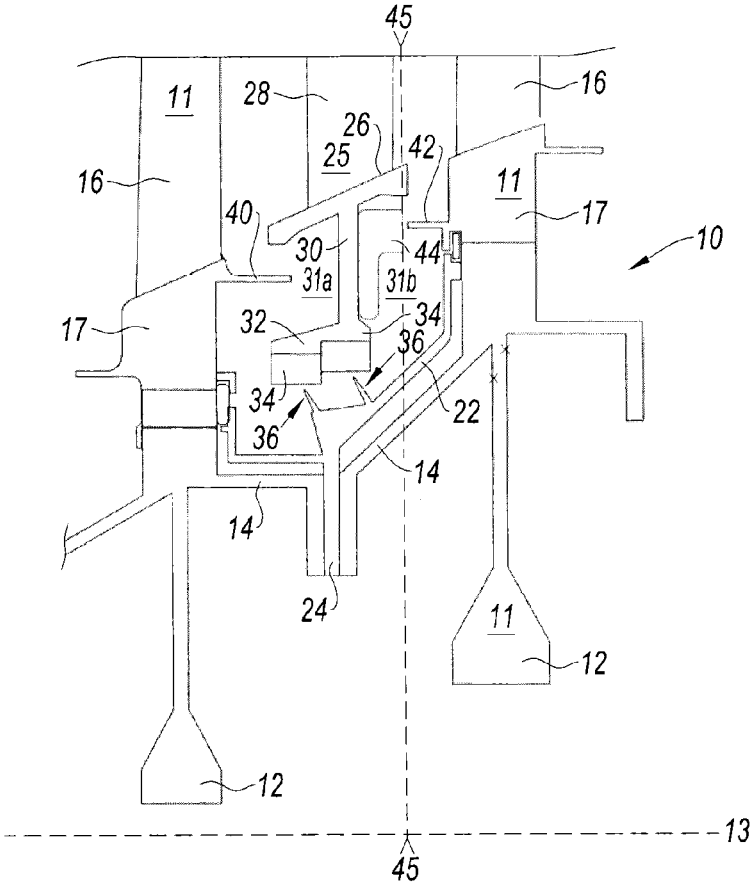
FIG. 2 is a view in axial section of a rotor comprising a first embodiment according to the invention.
Figure 4:
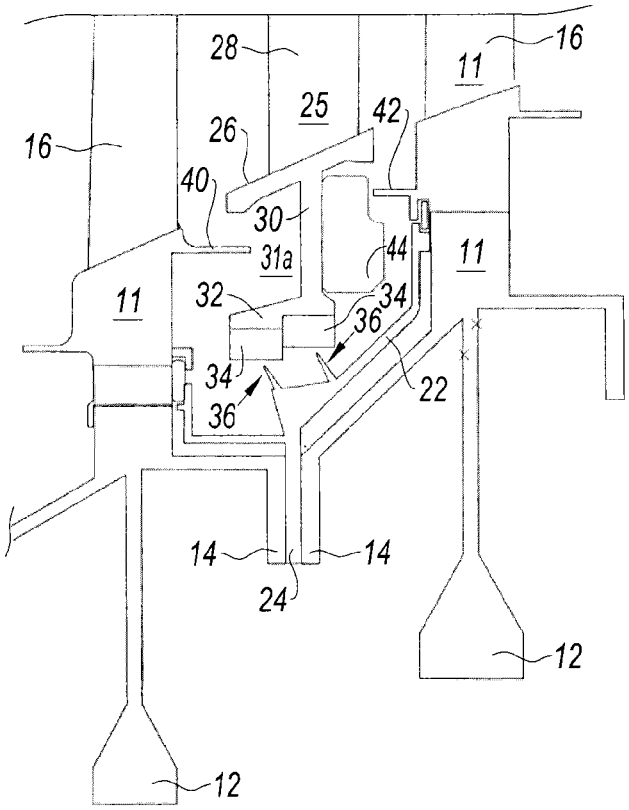
FIG. 4 is a view in axial section of a rotor comprising a third embodiment according to the invention.

As shown in FIG. 2, the abradable material 44 may be in the shape of an inverted L and be mounted directly on the radial wall 30; it may alternatively be in the shape of an L and be mounted directly on the radial wall 30, as shown in FIG. 4.

Figure 3:
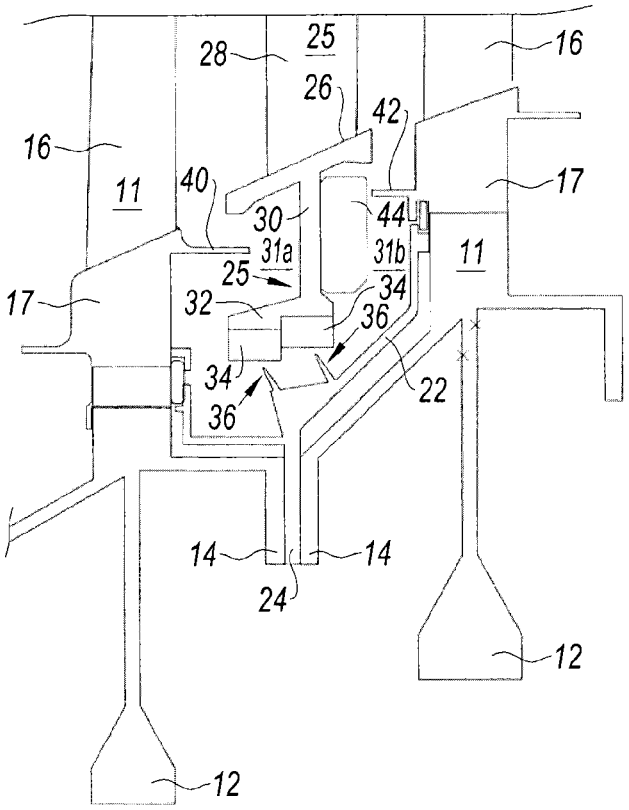
FIG. 3 is a view in axial section of a rotor comprising a second embodiment according to the invention.
Figure 5:
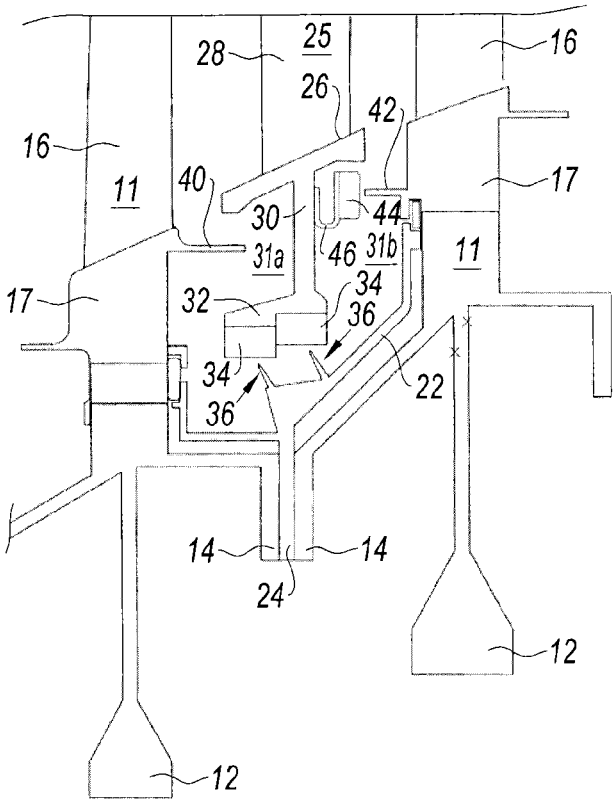
FIG. 5 is a view in axial section of a rotor comprising a fourth embodiment according to the invention.
Figure 6:
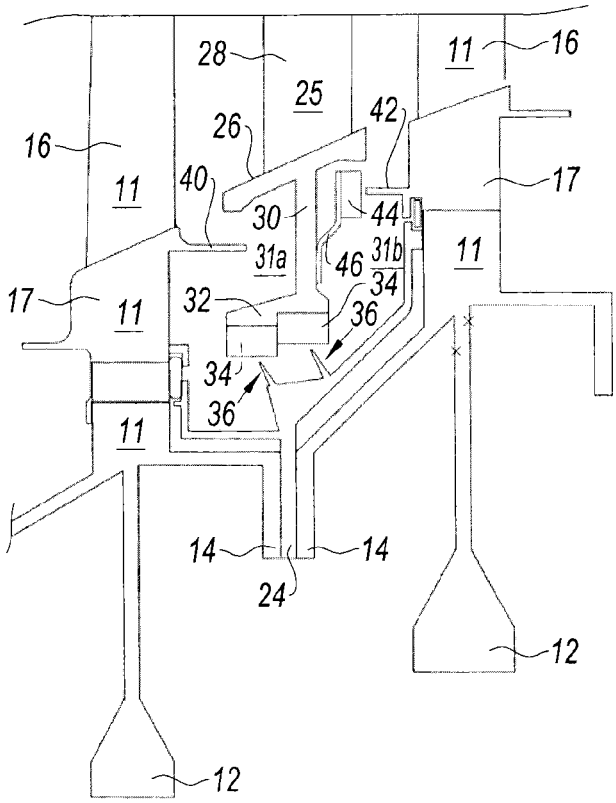
FIG. 6 is a view in axial section of a rotor comprising a fifth embodiment according to the invention.

The abradable material 44 may also be substantially rectangular, as shown in FIGS. 3, 5 and 6.

The abradable element 44 may be mounted, for example by brazing, directly on the radial wall 30 of the stator 25, as shown in FIGS. 2, 3 and 4.

The abradable element 44 may also be mounted on support means 46 attached to the radial wall 30 of the stator 25, such as a metal sheet bent into a U shape, a Z shape or any other shape which makes it possible to form a labyrinth seal between the abradable element 44 and one of the spurs, as shown in FIGS. 5 and 6.

Figure 7:
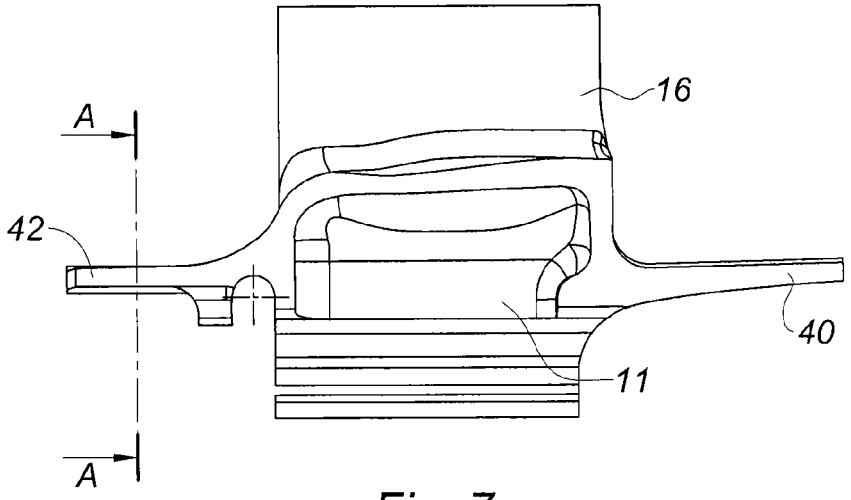
FIG. 7 is a view in section of part of a turbine rotor comprising an upstream spur and a downstream spur.
Figure 8:
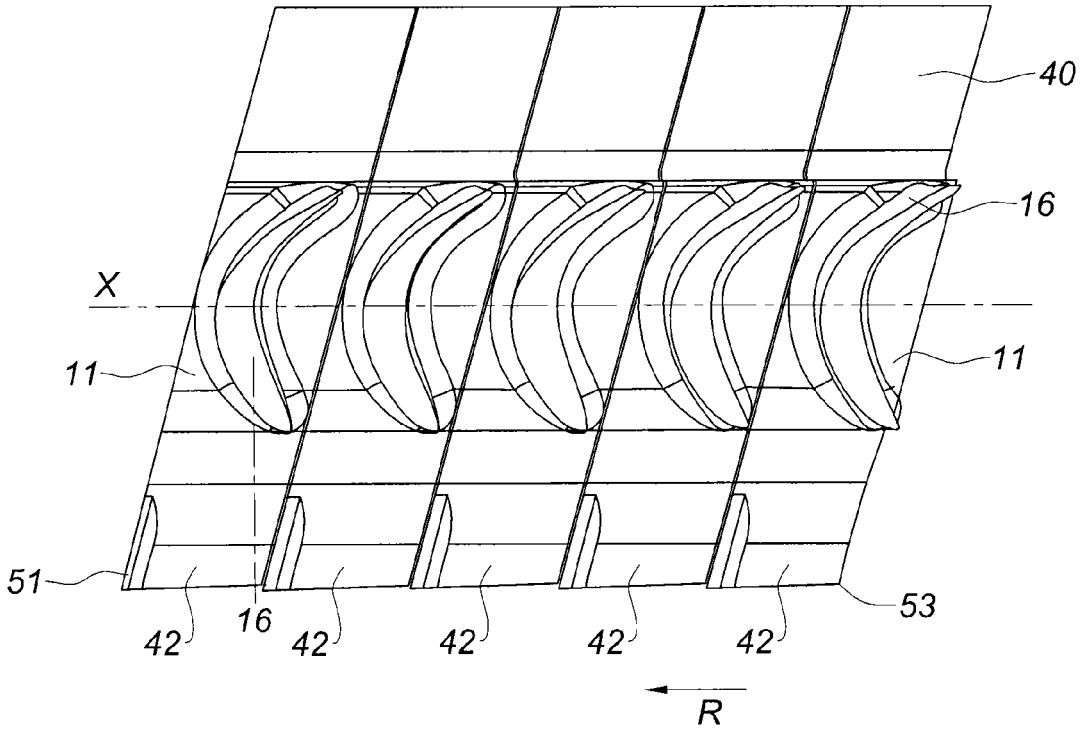
FIG. 8 is a view from above of part of the turbine rotor of FIG. 7 comprising a plurality of upstream and downstream spurs.
Figure 9:
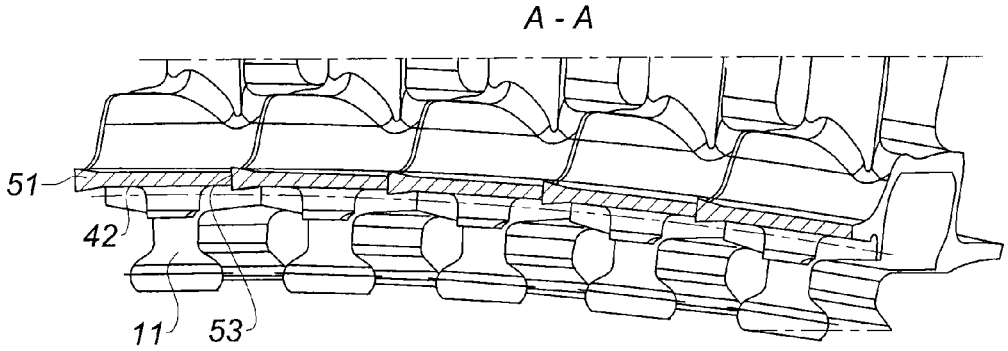
FIG. 9 is a view in section of part of the rotor of FIG. 7, through the plane of section A-A.
Figure 10A:
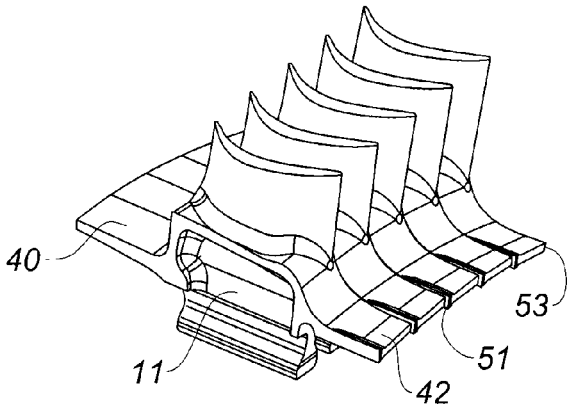
FIG. 10*a* is a view in perspective of part of the rotor of FIG. 7.
Figure 10B:
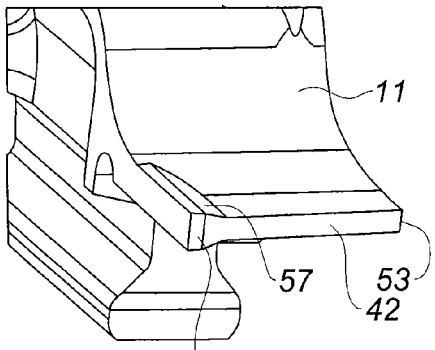
FIG. 10*b* is a view in perspective of part of an element of the rotor of FIG. 7.
Figure 10C:
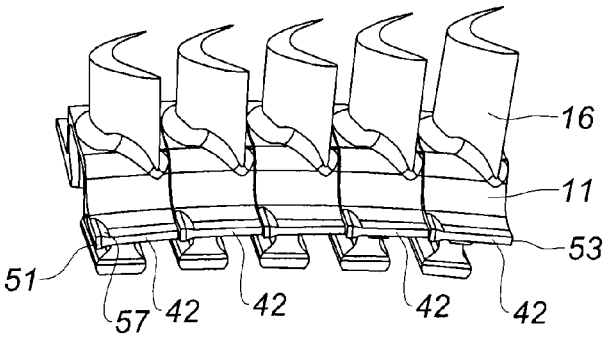
FIG. 10*c* is a view in perspective of part of the rotor of FIG. 7.

FIG. 7 describes a view in section of part of a rotor of a turbine 10 comprising an upstream spur 42 designed to machine an abradable part 44.

FIGS. 8 to 10*c* show a rotor 11 comprising a plurality of spurs 42 arranged one after the other, that is to say side-by-side. Each spur 42 is designed to machine an abradable part. To that end, each upstream spur 42 comprises a leading corner 51 arranged so as to cut into the abradable part 44 when the rotor 11 rotates in the direction of rotation R. Each upstream spur 42 further comprises a trailing corner 53 located back from the leading corner 51, that is to say configured such that the trailing corner 53 is closer to the axis X, which passes through the middle of the blades 16 of the rotor 11, than the leading corner 51.

The leading corner 51 is thus a very localized, radially thicker region of the spur 42, for the purpose of creating a clean line in the abradable part 44.

A hardening deposit can be deposited on the leading corner 51, or a heat treatment can be performed on the spurs 42 so as to harden them.

A chamfer 57 can be created so as to strengthen the leading corner 51.

The plurality of spurs 42 shown in FIGS. 8 to 12 makes it possible to better use, manage and optimize the abradable part 44, thus avoiding the spur 42 jamming therein.

Figure 11:
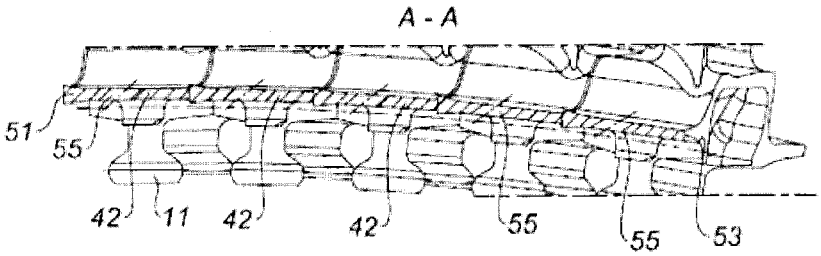
FIG. 11 is a view in section of part of the rotor of FIG. 7, through the plane of section A-A, the upstream spurs further comprising a plurality of openings.
Figure 12:
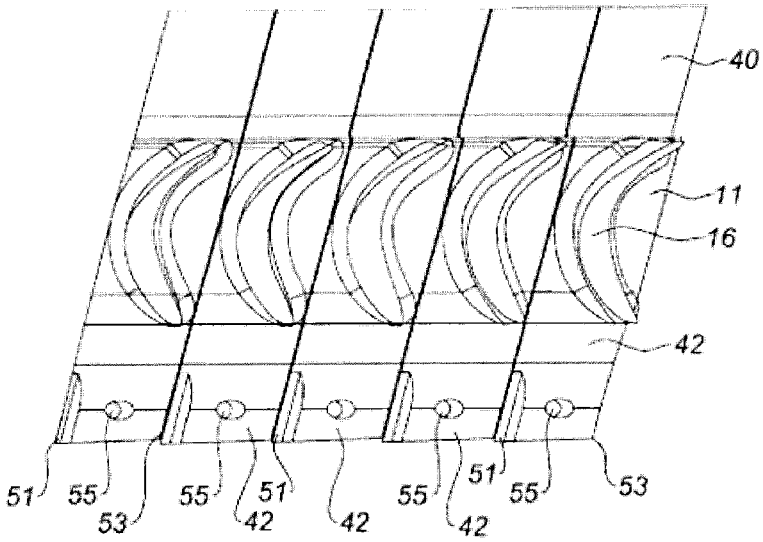
FIG. 12 is a view from above of part of the rotor of FIG. 11.

Moreover, when the turbine 10 is in use, a flow of air passes between the abradable part 44 and the labyrinth formed in the upstream cavity 31*b*. If this flow is not vented, an overpressure is created in the downstream cavity 31*b* of the stator, causing considerable heating. FIGS. 11 and 12 thus show the rotor of FIGS. 7 to 10*c* further comprising openings 55 for venting the overpressure from the downstream cavity 31*b*, such that the flow can be vented into the duct of the flow of the turbine. To make this purge easier, the openings 55 can be inclined, as shown in FIG. 11, in the opposite direction from the direction of rotation R in order to achieve a better scoop. The dimensions of these holes can be adapted to the aerothermodynamic requirements.

Figure 13:
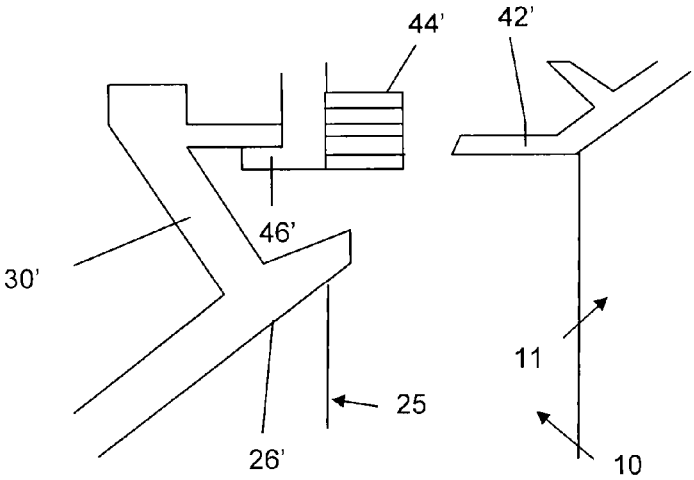
FIG. 13 is a view in axial section of a turbine comprising another embodiment according to the invention.

Reference is now made to FIG. 13, which is a schematic partial view in section of an outer platform 26' of a low-pressure turbine stator 25.

The outer platform 26' is latched onto a casing of the turbine 10 by means of a ring 46'. The outer platform 26' of the stators 25 comprises a radial wall 30' which extends radially outward from an outer surface of the platform 26'. The ring 46' is mounted downstream the radial wall and cooperate with both the radial wall 30' and the casing so as to latch the outer platform 26' relative to the casing.

Said ring 46' supports downstream an element 44' made of abradable material. The turbine rotor 11 comprises a spur 42' which is designed to act as a lip in order to form a labyrinth seal whose sealing plane is perpendicular to the axis of rotation of the turbine rotor 11.

The invention claimed is:

1. A turbine for a gas turbine engine comprising:

a turbine stator;

an upstream turbine rotor and a downstream turbine rotor; and an annular retaining flange for axially retaining blades of the downstream turbine rotor, wherein said turbine stator comprises an inner annular platform, said platform comprising a radial wall, said radial wall being integrally formed with said platform, wherein said radial wall delimits an upstream cavity and a downstream cavity between the turbine stator and the upstream turbine rotor and the downstream turbine rotor, respectively, and a cylindrical annulus which supports a first element of abradable material on an inner circumferential surface thereof, wherein the upstream turbine rotor comprises a downstream annular attachment flange and a downstream spur, wherein the downstream turbine rotor comprises an upstream annular attachment flange and an upstream spur, wherein the annular retaining flange comprises a radial wall and a lip which cooperates with the first element of abradable material to form a first labyrinth seal, wherein the radial wall of the annular retaining flange for axially retaining blades of the downstream turbine rotor is attached between the downstream annular attachment flange of the upstream turbine rotor and the upstream annular attachment flange of the downstream turbine rotor, wherein the upstream spur and the downstream spur are positioned substantially axially and the upstream spur and the downstream spur define a sealing baffle in the upstream cavity and the downstream cavity, respectively, and wherein the turbine stator comprises a second element of abradable material mounted on said platform and designed to engage with at least one of said spurs of the upstream turbine rotor and the downstream turbine rotor so as to form a second labyrinth seal.

2. The turbine as claimed in claim 1, wherein the second element of abradable material is designed to engage with the downstream spur of the upstream turbine rotor so as to form the second labyrinth seal.

3. The turbine as claimed in claim 1, wherein a plane defined by a surface at which the second element of abradable material is contacted is substantially perpendicular to an axis of the turbine rotor.

4. The turbine as claimed in claim 1, wherein the second element of abradable material is mounted on the radial wall of the platform of the turbine stator.

5. The turbine as claimed in claim 1, wherein the turbine stator further comprises means for supporting the abradable element, which means are mounted on said radial wall and are arranged so as to support the second element of abradable material.

6. The turbine as claimed in claim 5, wherein said supporting means comprises a ring.

7. The turbine as claimed in claim 1, wherein at least one of the spurs of the upstream turbine rotor and the downstream turbine rotor comprises an opening arranged so as to vent an overpressure of air from the corresponding cavity.

8. The turbine as claimed in claim 1, wherein the at least one of the spurs of the upstream turbine rotor and the downstream turbine rotor comprises a plurality of elements arranged one after the other, each of the elements being designed to engage with the second element of abradable material.

9. The turbine as claimed in claim 8, wherein each of the elements further comprises an opening for venting the overpressure of air from the corresponding cavity.

10. A method for strengthening a spur for a rotor of a turbine as claimed in claim 1, said spur being positioned substantially radially with respect to an axis of rotation of the rotor of the turbine, the method comprising hardening the spur by heat treatment or by a hardening deposit.

11. A turbine for a gas turbine engine comprising:

a turbine stator; and a turbine rotor, wherein said turbine stator comprises an outer annular platform, said platform comprising a radial wall, said radial wall being integrally formed with said platform, wherein said radial wall delimits an upstream cavity and a downstream cavity between the turbine stator and the turbine rotor, wherein the turbine rotor comprises an upstream spur and a downstream spur positioned substantially axially, the upstream spur and the downstream spur defining a sealing baffle in the upstream cavity and the downstream cavity, respectively, and wherein a ring carried by said platform supports an element of abradable material designed to engage with at least one of said spurs of the turbine rotor so as to form a labyrinth seal.

12. The turbine as claimed in claim 1 wherein a stiffness of an end of the at least one of the spurs of the turbine stator has been increased by heat treatment or by a hardening deposit.

* * * * *